US005806295A

United States Patent [19]

Robins et al.

[11] Patent Number: 5,806,295

[45] Date of Patent: Sep. 15, 1998

[54] PROTECTIVE APPAREL, MULTIPLE CORE CUT-RESISTANT YARN, AND METHOD OF CONSTRUCTING A MULTIPLE CORE CUT-RESISTANT YARN

[76] Inventors: Steven D. Robins, 9743 Dorset La., Eden Prairie, Minn. 55347; Robert H. Fleming, Jr., Rte. 1, Box 457, Dunlap, Tenn. 37327-9631

[21] Appl. No.: 862,327

[22] Filed: May 23, 1997

Related U.S. Application Data

[63] Continuation of Ser. No. 454,524, May 30, 1995, abandoned, which is a continuation-in-part of Ser. No. 231,635, Apr. 22, 1994, abandoned.

[51] Int. Cl.[6] ..... D02G 3/36

[52] U.S. Cl. ..... 57/220; 57/212; 57/218; 57/222; 57/13

[58] Field of Search ..... 57/210–223, 3, 57/15

[56] References Cited

U.S. PATENT DOCUMENTS

| | | | |
|---|---|---|---|
| Re. 19,551 | 4/1935 | Meiwald | 66/190 |
| 429,005 | 5/1890 | Bird | 57/218 X |
| 831,108 | 9/1906 | Ryder | 57/210 |
| 1,275,469 | 8/1918 | Pruessman | 57/211 X |
| 1,574,004 | 2/1926 | Ryder | 57/210 |
| 1,860,030 | 5/1932 | Hinchcliff | 28/143 |
| 1,947,302 | 2/1934 | Meiwald | 66/190 |
| 2,006,275 | 6/1935 | Meiwald | 66/169 |
| 2,137,692 | 11/1938 | Linke | 86/193 |
| 2,250,863 | 7/1941 | Goodloe | 66/170 |
| 3,490,224 | 1/1970 | Bourgeas | 57/210 |
| 3,883,898 | 5/1975 | Byrnes, Sr. | 2/167 |
| 3,953,893 | 5/1976 | Byrnes, Sr. | 2/51 |
| 4,004,295 | 1/1977 | Byrnes, Sr. | 2/161 R |
| 4,106,276 | 8/1978 | Hosoya | 57/216 X |
| 4,202,382 | 5/1980 | Westhead | 139/383 |
| 4,272,950 | 6/1981 | Bompard | 57/210 X |
| 4,299,884 | 11/1981 | Payen | 57/210 X |
| 4,384,449 | 5/1983 | Byrnes, Sr. et al. | 57/210 |
| 4,470,251 | 9/1984 | Bettcher | 57/230 |
| 4,523,425 | 6/1985 | Schild et al. | 57/210 X |
| 4,534,262 | 8/1985 | Swenson | 87/6 |
| 4,651,514 | 3/1987 | Collett | 57/227 |
| 4,777,789 | 10/1988 | Kolmes et al. | 57/210 |
| 4,838,017 | 6/1989 | Kolmes et al. | 57/210 |
| 4,912,781 | 4/1990 | Robins et al. | 57/210 X |
| 4,936,085 | 6/1990 | Kolmes et al. | 57/229 |
| 5,177,948 | 1/1993 | Kolmes et al. | 57/230 |
| 5,248,548 | 9/1993 | Toon | 57/210 X |
| 5,287,690 | 2/1994 | Toon | 2/169 |

FOREIGN PATENT DOCUMENTS

| | | | |
|---|---|---|---|
| 458 343 A1 | 11/1991 | European Pat. Off. | 57/210 |
| 498 216 A1 | 8/1992 | European Pat. Off. | 57/222 |
| 498216 | 8/1992 | European Pat. Off. | 57/222 |
| 718029 | 1/1932 | France | 66/190 |
| 2 393 879 | 1/1979 | France . | |
| 315038 | 10/1919 | Germany | 66/4 |
| 53-134 953 | 11/1978 | Japan | 57/218 |
| 1-183 544 | 7/1989 | Japan | 57/210 |
| 1183544-A | 7/1989 | Japan | 57/210 |
| 53-134953 | 7/1989 | Japan | 57/210 |

OTHER PUBLICATIONS

Sodemetex S.A., Advantages of the "Quipmaille" Process, All pages. Published prior to Apr. 22, 1994.

*Primary Examiner*—C. D. Crowder
*Assistant Examiner*—Tina R. Taylor
*Attorney, Agent, or Firm*—Adams Law Firm, P.A.

[57] ABSTRACT

A cut-resistant flexible yarn suitable for knitting, method of forming the cut-resistant yarn, and protective apparel incorporating the cut-resistant yarn are provided. The yarn includes a plurality of core units. Each of the core units includes a core yarn, and a flexible metallic filament wrapped around the core yarn. The plurality of core units are positioned adjacent to each other to form a bundle. At least one cover strand is wrapped around and encases the bundled core units to form a cover.

21 Claims, 2 Drawing Sheets

PROTECTIVE APPAREL, MULTIPLE CORE CUT-RESISTANT YARN, AND METHOD OF CONSTRUCTING A MULTIPLE CORE CUT-RESISTANT YARN

This application is a 1.62 file-wrapper continuation application of U.S. Ser. No. 08/454,524 filed May 30, 1995, now abandoned, which is a continuation-in-part of U.S. Ser. No. 08/231,635, filed Apr. 22, 1994, (abandoned).

TECHNICAL FIELD AND BACKGROUND OF THE INVENTION

This invention relates to protective apparel, multiple core cut-resistant yarn, and method of constructing a multiple core cut-resistant yarn. The yarn is particularly adapted for use in, for example, gloves, aprons and arm and leg covers used by employees in meat processing or packing plants, or in industrial metal fabrication plants. In particular, the gloves permit plant employees to more safely and efficiently perform their duties while avoiding injury due to accidental cuts from sharp knives or metal edges.

Prior art yarns use specific combinations of materials in attempting to achieve a cut resistant yarn core. The core is typically wrapped with cut-resistant and abrasion resistant cover yarns to facilitate knitting, and to give the yarn an acceptable hand. Such yarns have previously been incorporated in protective gloves. For example, U.S. Pat. No. 4,384,449 issued to Byrnes et al., discloses a protective glove formed of a yarn having a core of flexible wire alongside an aramid fiber strand, and wrapped with Aramid fiber strand going in opposite directions.

U.S. Pat. No. 4,470,251 issued to Bettcher, discloses a composite yarn having a core formed of two or three strands of metal wire combined with one strand of non-stretchable synthetic fiber run parallel to the wire. The core is then wrapped with at least two strands of synthetic fibers extending in opposite directions around the core.

U.S. Pat. No. 4,777,789 issued to Kolmes, et al., discloses a composite yarn having a core of synthetic fiber combined with a wire strand. The core is then wrapped with additional wire strands in opposite directions, and a cover wrapping applied to the composite. The wire strands are relatively heavy and stiff, ranging from 0.003 inch to 0.006 inch in diameter, and can also break and stick the wearer.

Japanese Patent 183,544 discloses a composite yarn with several cores aligned parallel to each other. The cores are formed of wires wrapped with synthetic fibers, and an additional fiber wrapped around the cores to form a cover for the yarn.

There are several factors that influence the cut resistance of a yarn. Through years of developing and manufacturing cut resistance yarns and apparel, the Applicants have learned that to achieve a high level of cut resistance, it is necessary to have a component in the yarn that is of similar hardness to the cutting edge. High performance fibers alone will not provide a sufficient level of cut resistance for many applications. Such fibers may be satisfactory against an edge that is not super sharp, but against a very sharp edge, they will cut fairly easily.

The majority of successful cut resistance yarns presently available, of which several are described above, use either a metal component or fiberglass as the hard element in the yarn. The fiberglass yarns put the fiberglass in the core with a synthetic wrap cover. The metal wire types usually have the metal component in the core, as described in the U.S. Pat. No. 4,384,449 issued to Byrnes et al and U.S. Pat. No. 4,470,251 issued to Bettcher, or multiple S and Z twist wrapped over a synthetic core yarn as described in U.S. Pat. No. 4,777,789 issued to Kolmes, et al., or a single wire wrapped synthetic core as manufactured by Protective Knitting, Inc.

The function of the hard component is not just the potential cut resistance it brings to the yarn, but in its ability to deflect a sharp edge. As the sharp edge contacts the yarn, it is deflected. If the fiber component is properly wrapped, then the fiber will shift or roll away from the edge resulting in minimal damage. This phenomenon of deflecting and rolling has been observed in many styles of cut resistant yarn. It is apparent that the hard component chosen should be as flexible as possible so to make the yarn knittable, and the article of apparel as flexible, soft, and comfortable as possible.

Experimentation has shown that a single core, regardless of what it is made up of, tends to act as a single unit. This is the case even when there are multiple ends of, for example, wire in the core. As the sharp edge strikes across the core, the wires tend to flatten out and contact the edge at the same time. Also, through experimentation, the Applicants have found that if you knit two lighter ends of cut-resistant yarn on a knitting machine, the yarn will have greater cut resistance than a single end incorporating the exact same quantities of materials.

Knitting multiple ends of cut-resistant yarns on standard knitting machines is very difficult because of the limits on the size of yarns that can be knitted and the gauge of the machines. Two ends can be knitted on a 5 gauge machine, but that yields a knit that is very open and very heavy, and a more expensive product. It is easier and less expensive to knit one end of a heavy denier than two ends equaling the same denier.

Although claiming comfort, flexibility, tactility, and good cut-resistance, the prior art yarn constructions described above fall short of achieving all the properties desired in protective apparel. The yarn construction and apparel items of the present invention utilize a yarn construction which is unique and achieves an enhanced degree of comfort and cut resistance, and maximizes the effect of deflecting and rolling of the sharp edge as described above.

The present invention overcomes several problems of prior art yarn designs by incorporating multiple core units in a single end of yarn. The yarn is formed having two or more core units each independent of the other. Each of the core units is formed of synthetic core yarn, and a flexible metallic filament wrapped around the core yarn to bind the core yarn together. The multiple core units are put together in a bundle, and then are covered by an outer wrapping that creates a single end of yarn for easier knitting.

A unique property of this invention which differs from the prior art is the manner in which the core units interact with each other because of the spiral effect caused by the metallic filament wraps meshing or nesting within each other in the bundle. The cores units tend to act independent of each other when contacted by a sharp object in a similar manner as if multiple separate ends were knitted together parallel with each other. At the same time, the interaction of the core units, or "meshing" effect, increases the deflection of the sharp edge, yet does not effect the flexibility of the yarn. The core units mesh when pressure is applied, but do not lock together in a way that would restrict their ability to move or roll.

This effect is similar to putting two identical springs together which will intermesh within each other. The yarn, however, since it is not as stiff as a spring, and since it also has a core yarn that limits how much the core units can intermesh, will not lock together like a spring. Like a spring however the edges of the metal will come closer together and tend to fill in the open spaces, thereby multiplying the exposure to the blade. This effectively increases the density of the metallic component, and thus, increases the deflection of the sharp edge. At the same time, the yarns are still sufficiently free to move and roll independent of one another.

Multiple core units allow multiple deflection points giving more of a chance for the fiber to roll away and not cut. The interaction of the core units further increases this effect. This allows knitting of a single end of yarn, while achieving substantially the same benefits of knitting multiple ends of yarn together. The net result is an increase in cut resistance without having to increase the hard component and thereby stiffen the resulting yarn. More cut resistance is achieved per unit of component used in the yarn as compared to other prior art methods of yarn construction.

SUMMARY OF THE INVENTION

Therefore, it is an object of the invention to provide a cut-resistant yarn for use in body protective apparel.

It is another object of the invention to provide a body protective garment resistant to cuts.

It is another object of the invention to provide a method of constructing a cut-resistant yarn for being incorporated into a protective garment.

It is another object of the invention to provide a cut-resistant yarn which is particularly adapted for use in protective gloves worn by workers who use cutting implements, or who are exposed to sharp metal edges.

These and other objects of the present invention are achieved in the preferred embodiments disclosed below by providing a cut-resistant, flexible yarn suitable for knitting. The cut-resistant yarn includes a plurality of core units. Each of the core units includes a core yarn and a flexible metallic filament wrapped around the core yarn. The plurality of core units are positioned adjacent to each other to form a bundle. At least one cover strand is wrapped around and encases the bundled core units to form a yarn cover.

According to one preferred embodiment of the invention, the metallic filament of the core unit is a flexible stainless steel filament having a diameter in a range of between 6 microns and 50 microns.

According to another preferred embodiment of the invention, the core yarn of the core unit is selected from a fiber group including either of polyethylene, polyester, copolyesters, aramid, liquid crystal polymer fibers, polyamides, PVA-based fibers, polysulfide fibers, and synthetically produced silk fibers.

According to yet another preferred embodiment of the invention, the core yarn of the core unit is selected from a fiber group including either of natural organic and inorganic fibers.

According to yet another preferred embodiment of the invention, the cover strand is a multi-filament fiber strand selected from a fiber group including either of polyethylene, polyester, copolyesters, aramid, liquid crystal polymer fibers, polyamides, PVA-based fibers, polysulfide fibers, and synthetically produced silk fibers.

According to yet another preferred embodiment of the invention, the cover strand is a multi-filament fiber strand selected from a fiber group including either of natural organic and inorganic fibers.

According to yet another preferred embodiment of the invention, the cover strand is a flexible stainless steel filament having a diameter in a range of between 6 microns and 50 microns An article of apparel according to one embodiment of the invention is constructed of a cut-resistant yarn. The cut-resistant yarn includes a plurality of core units. Each of the core units includes a core yarn and a flexible metallic filament wrapped around the core yarn. The plurality of core units are positioned adjacent to each other to form a bundle. At least one cover strand is wrapped around and encases the bundled core units to form a yarn cover.

An embodiment of the method for forming a cut-resistant yarn according to the invention comprises the steps of wrapping a flexible metallic filament around a core yarn to form a core unit, positioning a plurality of core units adjacent to each other to form a bundle, and wrapping and encasing at least one cover strand around the bundled core units to form a yarn cover.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
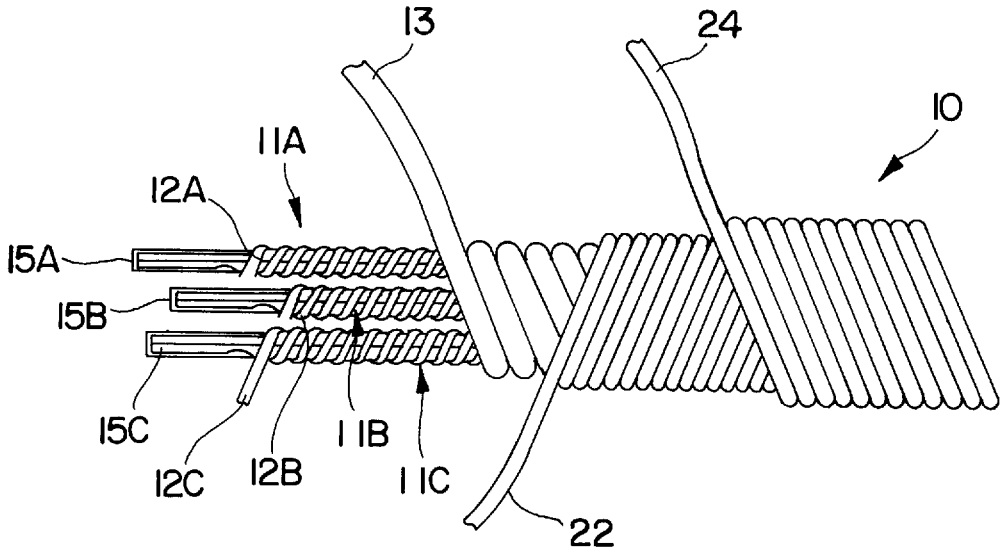
FIG. 1 is a fragmentary view of a cut-resistant yarn according to the present invention.

Referring now specifically to the drawings, a composite cut-resistant yarn according to the present invention is illustrated in FIG. 1 and shown generally at reference numeral 10. The yarn 10 is constructed of a plurality of cores units 11A, 11B, and 11C. The core units 11A, 11B, and 11C are laid together and positioned adjacent to each other to form a bundle. A slight twist is preferably imparted on the bundle to spiral the core units 11A, 11B, and 11C around each other.

Once bundled, the core units 11A, 11B, and 11C are wrapped together with a high abrasion-resistant and cut-resistant interior cover strand 13. The cover strand 13 is preferably a 630 denier, high or ultra high molecular weight polyethylene continuous multi-filament yarn. In an alternative embodiment, the cover strand 13 may include one or more stainless steel filaments with a diameter ranging from between 6 microns and 50 microns After application of the interior cover strand 13, the bundled core units 11A, 11B, and 11C are preferably wrapped by one or more additional exterior cover strands 22 and 24. The cover strands 22 and 24 are preferably identical multi-filament strands including 800 denier, pre-shrunk nylon or polyester fibers. According to one embodiment, the cover strand 22 is wrapped in a clockwise direction over the cover strand 13 and core units 11A, 11B, and 11C. The cover strand 24 is then wrapped over strand 22 in an opposite, counterclockwise direction. The resulting cover provides a balanced yarn suitable for knitting apparel. Additional cover strands (not shown) of smaller denier may be added if a smoother yarn is desired.

Figure 2:
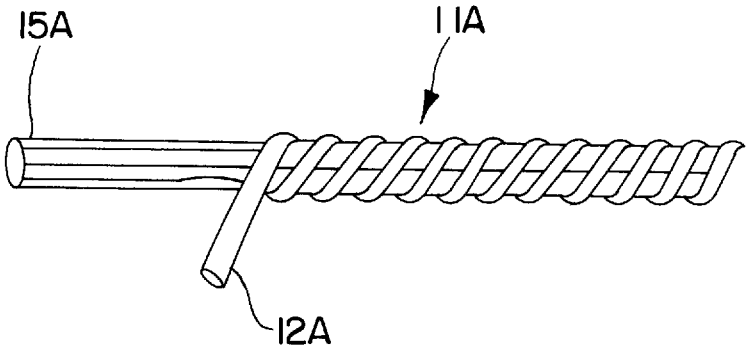
FIG. 2 is a fragmentary view illustrating a single core unit of the cut-resistant yarn.

A single core unit 11A of the cut-resistant yarn 10 is shown in detail in FIG. 2. The core unit 11A is constructed of a core yarn 15A formed of synthetic multi-filament fiber strands bound together by a flexible continuous metallic filament 12A. The core yarn 15A is preferably a liquid crystal polymer yarn having a denier ranging from between 40 and 1,000 with 600 denier being most preferable. Alternatively, the core yarn 15A may include olefin fibers, such as high or ultra high molecular weight polyethylene, polyester and high-tenacity polyesters and copolyesters, liquid crystal polymer fibers such as VECTRAN® fibers produced by Hoechst-Celanese, polyamides, PVA-based fibers, polysulfide-based fibers, natural fibers, and synthetically produced silk fiber strands. The core units 11B and 11C, shown in FIG. 1, preferably include identical core yarns 15B and 15C bound together, respectively, by identical metallic filaments 12B and 12C.

The metallic filaments 12A, 12B, and 12C are preferably formed of fully annealed stainless steel, and have a diameter ranging from between 6 microns and 50 microns. In another embodiment, a plurality of metallic filaments are wrapped around each of the core yarns to form the core units. For example, between 2 and 250 metallic filaments may be included in each core unit with about 91 filaments being the most preferred in this embodiment. The size of each metallic filament may range from between 6 microns and 50 microns with about 12 microns being the most preferred size.

Figure 3:
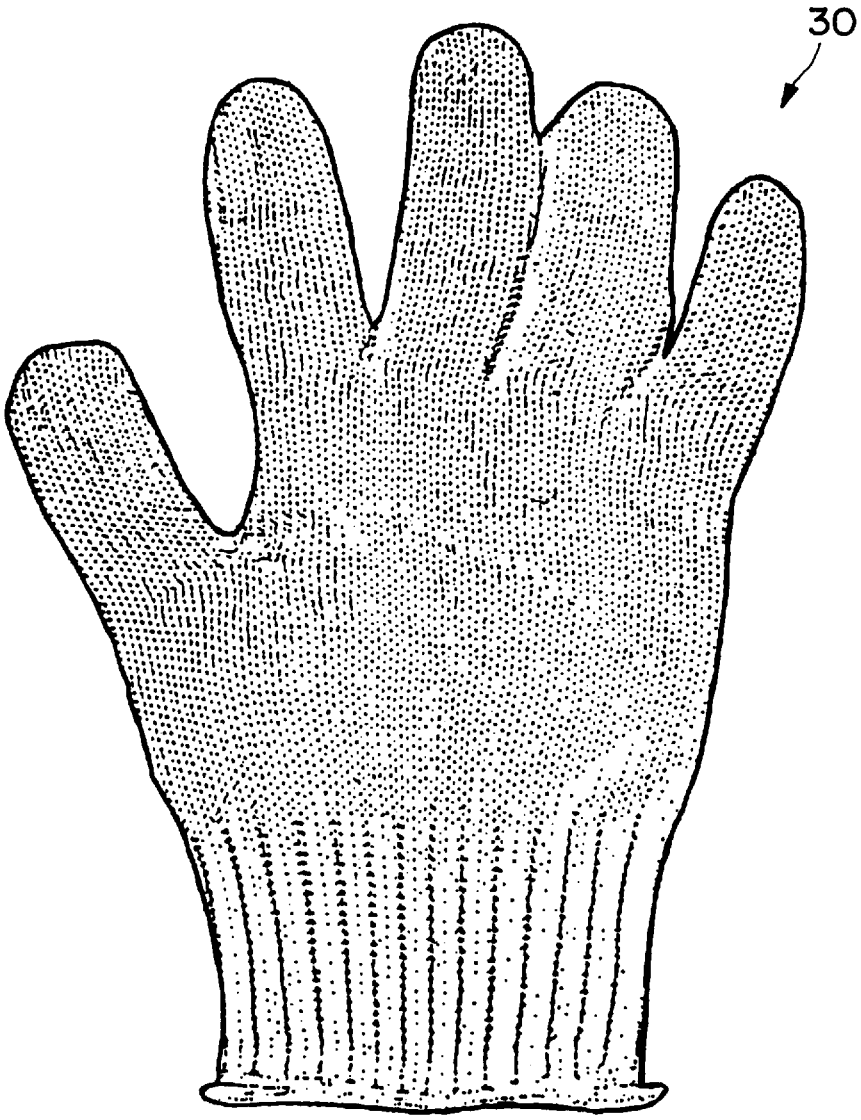
FIG. 3 is a protective glove incorporating a cut-resistant yarn according to the present invention.

The above cut-resistant yarn 10 may be incorporated into many different types of protective apparel. As shown in FIG. 3, the yarn 10 may be run through standard glove knitting equipment to form a seamless cut-resistant glove 30. Also, standard V-bed, flatbed, or circular-knitting equipment can be used to make cut-resistant sleeves, leggings or aprons, using standard knitting techniques well known in the art.

In an alternate embodiment (not shown), the cut-resistant yarn includes only two core units with core yarns formed of nylon. The use of nylon creates a less cut-resistant and lighter yarn suitable for knitting lighter weight, less expensive apparel, such as a protective liner glove that is worn under another glove.

In addition, the interior and exterior cover strands 13, 22, and 24 described above may be formed of multi-filament strands including olefin fibers, such as high or ultra high molecular weight polyethylene, aramid, polyester and high-tenacity polyesters and copolyesters, liquid crystal polymer fibers such as VECTRAN® fibers produced by Hoechst-Celanese, polyamides such as nylon, PVA-based fibers, polysulfide-based fibers, natural fibers, and synthetically produced silk fiber strands.

A composite cut-resistant yarn, method of forming a composite cut-resistant yarn, and protective apparel are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A cut-resistant, flexible yarn suitable for knitting, comprising:

(a) a plurality of core units, each of said core units comprising a core yarn and a spirally-wound, flexible, continuous metallic filament wrapped around said core yarn, said metallic filament defining a plurality of longitudinally-spaced metallic wraps along the length of said core yarn;

(b) said plurality of core units being positioned adjacent to each other to form a bundle, such that upon application of a sharp edge to said bundle, the metallic wraps of the metallic filament of one core unit enter the spaces between the metallic wraps of the metallic filament of an adjacent core unit such that the adjacent core units intermesh and cooperate to resist cutting of their respective core yarns; and (c) at least one cover strand wrapped around and encasing the bundled core units to form a yarn cover.

2. A yarn according to claim 1, wherein the metallic filament of said core unit comprises a flexible stainless steel filament having a diameter in a range of between 6 microns and 50 microns.

3. A yarn according to claim 1, wherein the core yarn of said core unit is selected from a fiber group consisting of polyethylene, polyester, copolyesters, aramid, liquid crystal polymer fibers, polyamides, PVA-based fibers, polysulfide fibers, and synthetically produced silk fibers.

4. A yarn according to claim 1, wherein the core yarn of said core unit is selected from a fiber group consisting of natural organic and inorganic fibers.

5. A yarn according to claim 1, wherein said at least one cover strand comprises a multi-filament fiber strand selected from a fiber group consisting of polyethylene, polyester, copolyesters, aramid, liquid crystal polymer fibers, polyamides, PVA-based fibers, polysulfide fibers, and synthetically produced silk fibers.

6. A yarn according to claim 1, wherein said at least one cover strand comprises a multi-filament fiber strand selected from a fiber group consisting of natural organic and inorganic fibers.

7. A yarn according to claim 1, wherein said at least one cover strand comprises a flexible stainless steel filament having a diameter in a range of between 6 microns and 50 microns.

8. A cut-resistant, flexible yarn suitable for knitting, comprising:

(a) a plurality of core units, each of said core units comprising a core yarn, and a plurality of spirally-wound, flexible, continuous metallic filaments wrapped around said core yarn, said metallic filaments each defining a plurality of longitudinally-spaced metallic wraps along the length of said core yarn;

(b) said plurality of core units being positioned adjacent to each other to form a bundle, such that upon application of a sharp edge to said bundle, the metallic wraps of the metallic filaments of one core unit enter the spaces between the metallic wraps of the metallic filaments of an adjacent core unit such that the adjacent core units intermesh and cooperate to resist cutting of their respective core yarns; and (c) at least one cover strand wrapped around and encasing the bundled core units to form a yarn cover.

9. A cut-resistant, flexible yarn suitable for knitting, comprising:

(a) a plurality of core units, each of said core units comprising a liquid crystal polymer multi-filament fiber core yarns in a range of between 40 and 1,000 denier, and a spirally-wound, flexible, continuous metallic filament wrapped around the core yarn, said metallic filament defining a plurality of longitudinally-spaced metallic wraps along the length of the core yarn;

(b) said plurality of core units being positioned adjacent to each other to form a bundle, such that upon application of a sharp edge to said bundle, the metallic wraps of the metallic filament of one core unit enter the spaces between the metallic wraps of the metallic filament of an adjacent core unit such that the adjacent core units intermesh and cooperate to resist cutting of their respective core yarns; and (c) at least one synthetic multi-filament fiber cover strand wrapped around and encasing the bundled core units to form a yarn cover.

10. A cut-resistant, flexible yarn suitable for knitting, comprising:

(a) a plurality of core units, each of said core units comprising a high strength polyethylene multi-filament fiber core yarn in a range of between 40 and 1,000 denier, and a spirally-wound, flexible, continuous metallic filament wrapped around the core yarn, said metallic filament defining a plurality of longitudinally-spaced metallic wraps along the length of the core yarn;

(b) said plurality of core units being positioned adjacent to each other to form a bundle, such that upon application of a sharp edge to said bundle, the metallic wraps of the metallic filament of one core unit enter the spaces between the metallic wraps of the metallic filament of an adjacent core unit such that the adjacent core units intermesh and cooperate to resist cutting of their respective core yarns; and (c) at least one synthetic multi-filament fiber cover strand wrapped around and encasing the bundled core units to form a yarn cover.

11. A cut-resistant, flexible yarn suitable for knitting, comprising:

(a) a plurality of core units, each of said core units comprising an aramid multi-filament fiber core yarn in a range of between 40 and 1,000 denier, and a spirally-wound, flexible, continuous metallic filament wrapped around the core yarn, said metallic filament defining a plurality of longitudinally-spaced metallic wraps along the length of the core yarn;

(b) said plurality of core units being positoned adjacent to each other to form a bundle, such that upon application of a sharp edge to said bundle, the metallic wraps of the metallic filament of one core unit enter the spaces between the metallic wraps of the metallic filament of an adjacent core unit such that the adjacent core units intermesh and cooperate to resist cutting of their respective core yarns; and (c) at least one synthetic multi-filament fiber strands wrapped around and encasing the bundled core units to form a yarn cover.

12. An article of apparel constructed using standard knitting techniques, and including a cut-resistant, flexible yarn comprising;

(a) a plurality of core units, each of said core units comprising a core yarn, and a spirally-wound, flexible, continuous metallic filament wrapped around the core yarn, said metallic filament defining a plurality of longitudinally-spaced metallic wraps along the length of the core yarn;

(b) said plurality of core units being positioned adjacent to each other to form a bundle, such that upon application of a sharp edge to said bundle, the metallic wraps of the metallic filament of one core unit enter the spaces between the metallic wraps of the metallic filament of an adjacent core unit such that the adjacent core units intermesh and cooperate to resist cutting of their respective core yarns; and (c) at least one cover strand wrapped around and encasing the bundled core units to form a yarn cover.

13. An article of apparel according to claim 12, wherein the metallic filament of said core unit comprises a flexible stainless steel fiber having a diameter in a range of between 6 microns and 50 microns.

14. An article of apparel according to claim 12, wherein the core yarn of said core unit is selected from a fiber group consisting of polyethylene, polyester, copolyesters, aramid, liquid crystal polymer fibers, polyamides, PVA-based fibers, polysulfide fibers, and synthetically produced silk fibers.

15. An article of apparel according to claim 12, wherein the core yarn of said core unit is selected from a fiber group consisting of natural organic or inorganic fibers.

16. An article of apparel according to claim 12, wherein said at least one cover strand comprises a multi-filament fiber strand selected from a fiber group consisting of polyethylene, polyester, copolyesters, aramid, liquid crystal polymer fibers, polyamides, PVA-based fibers, polysulfide fibers, and synthetically produced silk fibers.

17. An article of apparel according to claim 12, wherein said at least one cover strand comprises a multi-filament fiber strand selected from a fiber group consisting of natural organic and inorganic fibers.

18. An article of apparel according to claim 12, wherein said at least one cover strand comprises a flexible stainless steel filament having a diameter in a range of between 6 microns and 50 microns.

19. An article of apparel according to claim 12, wherein said article of apparel comprises a glove for the hand, knitted using standard glove knitting equipment.

20. An article of apparel constructed using standard knitting techniques, and including a cut-resistant, flexible yarn comprising:

(a) a plurality of core units, each of said core units comprising a core yarn, and a plurality of spirally-wound, flexible, continuous metallic filaments wrapped around said core yarn, said metallic filaments each defining a plurality of longitudinally-spaced metallic wraps along the length of said core yarn;

(b) said plurality of core units being positioned adjacent to each other to form a bundle, such that upon application of a sharp edge to said bundle, the metallic wraps of the metallic filaments of one core unit enter the spaces between the metallic wraps of the metallic filaments of an adjacent core unit such that the adjacent core units intermesh and cooperate to resist cutting of their respective core yarns; and (c) at least one cover strand wrapped around and encasing the bundled core units to form a yarn cover.

21. A method of forming a flexible, cut-resistant yarn suitable for knitting, comprising the steps of:

(a) spirally-wrapping a flexible, continuous metallic filament around a core yarn to form a core unit, said metallic filament defining a plurality of longitudinally-spaced metallic wraps along the length of the core yarn;

(b) positioning a plurality of core units adjacent to each other to form a bundle, such that upon application of a sharp edge to said bundle, the metallic wraps of the metallic filament of one core unit enter the spaces between the metallic wraps of the metallic filament of an adjacent core unit such that the adjacent core units intermesh and cooperate to resist cutting of their respective core yarns; and (c) wrapping and encasing at least one cover strand around the bundled core units to form a yarn cover.

* * * * *